US007631833B1

(12) United States Patent
Ghaleb et al.

(10) Patent No.: US 7,631,833 B1
(45) Date of Patent: Dec. 15, 2009

(54) SMART COUNTER ASYMMETRIC THREAT MICROMUNITION WITH AUTONOMOUS TARGET SELECTION AND HOMING

(75) Inventors: Sam Ghaleb, Ridgecrest, CA (US); James Bobinchak, Ridgecrest, CA (US); Keith P. Gray, Ridgecrest, CA (US); Rodney E. Heil, Ridgecrest, CA (US); Philip T. Aberer, Ridgecrest, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/833,811

(22) Filed: Aug. 3, 2007

(51) Int. Cl.
*F42B 10/62* (2006.01)
*F41G 9/00* (2006.01)
*F42B 10/00* (2006.01)

(52) U.S. Cl. ..... 244/3.15; 244/3.1; 244/3.16; 244/3.21; 102/382; 102/384; 89/1.11; 89/1.51; 701/200; 701/207; 701/213

(58) Field of Classification Search ..... 244/3.1–3.3, 244/4 R, 13, 14, 16, 75.1, 76 R, 175, 189, 244/190; 89/1.11, 1.51; 102/382–397; 342/357.01–357.17; 701/1, 3, 200, 207, 213–216
See application file for complete search history.

(56) References Cited

U.S. PATENT DOCUMENTS 4,267,562 A * 5/1981 Raimondi ..... 89/1.11
4,522,356 A * 6/1985 Lair et al. ..... 244/3.15
4,726,224 A * 2/1988 D'Ausilio ..... 244/3.15
4,738,411 A * 4/1988 Ahlstrom et al. ..... 244/3.15
4,750,423 A * 6/1988 Nagabhushan ..... 89/1.51
5,206,452 A * 4/1993 Stamper et al. ..... 89/1.11
5,340,056 A * 8/1994 Guelman et al. ..... 244/3.16
5,344,105 A * 9/1994 Youhanaie ..... 244/3.14
5,379,966 A * 1/1995 Simeone et al. ..... 244/3.11
5,443,227 A * 8/1995 Hsu ..... 244/3.12
5,458,041 A * 10/1995 Sun et al. ..... 89/1.11
5,471,213 A * 11/1995 Hergesheimer ..... 244/3.14
5,511,218 A * 4/1996 Castelaz ..... 89/1.11
5,521,817 A * 5/1996 Burdoin et al. ..... 244/3.14
5,554,994 A * 9/1996 Schneider ..... 342/357.06
5,855,339 A * 1/1999 Mead et al. ..... 244/3.11
6,037,899 A * 3/2000 Weber ..... 342/357.06
6,196,496 B1 * 3/2001 Moskovitz et al. ..... 244/3.15

(Continued)

*Primary Examiner*—Bernarr E Gregory
(74) *Attorney, Agent, or Firm*—Brian Drazich

(57) ABSTRACT

The present invention provides an unpowered low-cost "smart" micromunition unit for a weapon system for defense against an asymmetric attack upon ships and sea or land based facilities. A plurality of air dropped micromunition units are each capable of detecting and tracking a plurality of maneuvering targets and of establishing a fast acting local area wireless communication network among themselves to create a distributed database stored in each deployed micromunition unit for sharing target and micromunition unit data. Each micromunition unit autonomously applies stored algorithms to data from the distributed database to select a single target for intercept and to follow an intercept trajectory to the selected target. It is emphasized that this abstract is provided to comply with the rules requiring an abstract that will allow a searcher or other reader to quickly ascertain the subject matter of the technical disclosure. It is submitted with the understanding that it will not be used to interpret or limit the scope of the claims.

10 Claims, 5 Drawing Sheets

U.S. PATENT DOCUMENTS 6,653,972 B1 * 11/2003 Krikorian et al. ..... 244/3.11
6,817,568 B2 * 11/2004 Spate et al. ..... 244/3.15
6,910,657 B2 * 6/2005 Schneider ..... 244/3.11
7,032,858 B2 * 4/2006 Williams ..... 244/3.15
7,422,175 B1 * 9/2008 Bobinchak et al. ..... 244/3.15

* cited by examiner

SMART COUNTER ASYMMETRIC THREAT MICROMUNITION WITH AUTONOMOUS TARGET SELECTION AND HOMING

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention relates to an autonomous air to surface micromunition adapted for distributed information sharing between a plurality of such autonomous micromunitions to cooperatively acquire, track, pursue and intercept a multiplicity of independent highly maneuverable asymmetric threats.

BACKGROUND OF THE INVENTION

The present invention satisfies an urgent need for an effective counter-measure to asymmetric threats deployed to intercept and engage warships, other vessels, or military or civilian assets at a very close range. Recent history has shown that while U.S. Navy ships generally have great firepower capability against both airborne threats and other large ships, they have a reduced ability to effectively defend themselves against threats, which are typified by a plurality of small boats such as Boghammers, more advanced catamarans, and speedboats, armed with high explosive charges, anti-ship missiles, or torpedoes, for example. These threats, deemed asymmetric threats, are intended and deployed to intercept and engage the warship or other asset at a very close range. They may utilize large caches of onboard explosives or guided or unguided weapons to attack the ship. This type of attack is primarily encountered in littoral waters and regions where waterways and commercial shipping restrict the warships from maneuvering and/or effectively utilizing their existing weapons systems. One of the most serious asymmetric threat tactics is described as the swarm tactic. This type of attack typically involves many small boats utilizing their high speed and maneuverability to attack a warship in sufficient numbers so as to overwhelm any self-defense capability the ship might have. Further, swarm tactics may also be found in some land-based scenarios where the attacking vessels are armed motor vehicles such as automobiles, small trucks, or jeeps fitted with automatic weapons, rocket propelled grenades, unguided missiles, or explosive charges, for example. The present invention provides an effective counter-measure to such asymmetric threats. Moreover, the present invention may be effectively employed against a variety of land based "soft-skinned" unarmored or lightly armored mobile or stationary targets such as vehicle convoys, radar sites, rocket launchers, and their control stations, for example. A key element of the present invention is a small, low-cost, lightweight, and maneuverable air to surface "smart" micromunition unit that is adapted to communicate with other such micromunition units to cooperatively acquire, track, pursue and intercept a plurality of highly maneuverable asymmetric threats, as well as a small low-cost but effective warhead.

SUMMARY OF THE INVENTION

Figure 1:
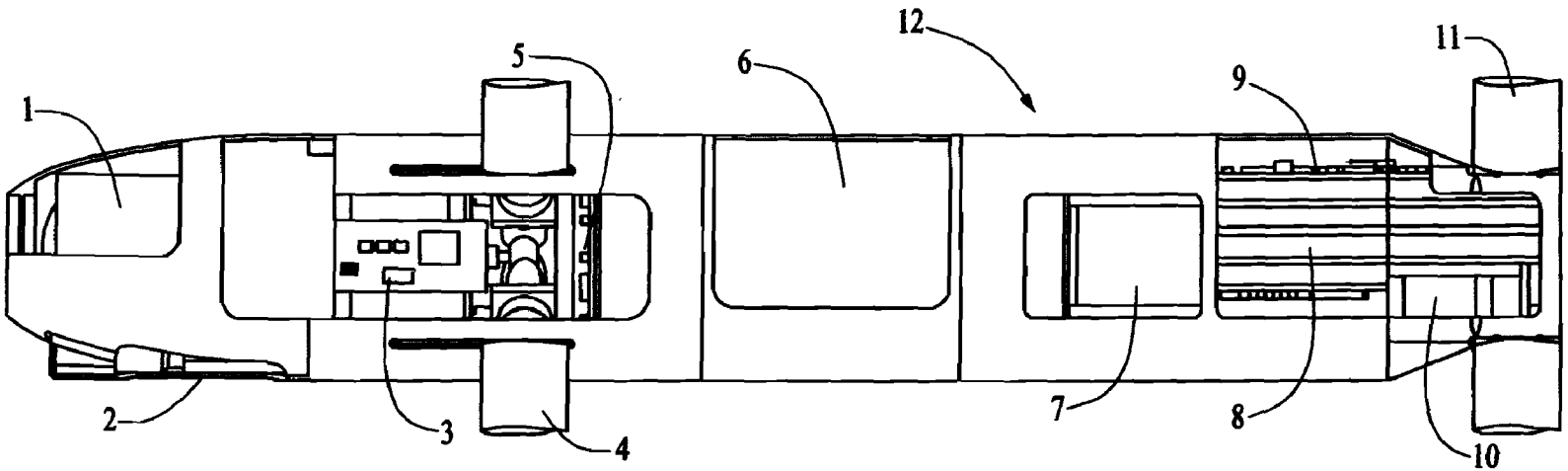
FIG. 1 of the drawings is a side partial cut-a-way view of a preferred plan form of the micromunition canister.

The present invention provides a weapon system component comprising an unpowered low-cost smart micromunition unit (hereinafter "micromunition," "micromunitions," "canister," or "canisters," or "airframe" or "airframes") that are deployed or dropped from a weapons bus or deployment platform (such as a manned or unmanned aircraft, a missile, or other aerial vehicle, for example) that has been directed to an area threatened by an asymmetric attack. Once dropped or deployed, the plurality of micromunitions establish a fast acting local area wireless communication network (LAN) for communication between themselves. Each micromunition is a node in that wireless communication network and independently collects target data using onboard sensors such as an electro-optical/infrared sensor and then shares that target information among the group of deployed micromunitions.

Robust assignment algorithms provide the means for optimally assigning micromunitions to targets. The assignment objective may be selected to achieve a desired outcome such as to maximize the global probability of intercepting all targets, or it to maximize the probability of intercepting a specific high-value target at the expense of missing a lower value target, or to distribute impacts on the target to maximize the probability of a micromunition entering a vulnerable volume, for example. This approach can achieve large lethality footprints that are not possible with a single micromunition or with clusters of micromunitions acting unilaterally.

Distributed information sharing is essential to achieving cooperation between the micromunitions and for maintaining group cohesion, avoiding micromunition collisions, pursuing multiple targets, and optimally assigning micromunitions to engage maneuvering targets. Once assigned to a specific target, each micromunition then guides to a selected aimpoint on the target and detonates. Depending on the target, more than one micromunition unit may be assigned to it.

As will be described in further detail herein, each micromunition or canister includes the following components and subsystems: advanced computer implemented algorithms for target acquisition and weapon-target pairing; a low-cost electro-optical or infrared sensor to acquire and track targets; a fast wireless communication transceiver for communication between the micromunition units; a laser range finder; an Inertial Measuring Unit (IMU); a Global Position System (GPS); a Guidance & Control (G&C) system; and a computer processor; as well as a small highly lethal warhead.

The "smart" micromunition of the present invention cooperates with other deployed like micromunitions to achieve advantages not available with other proposed or presently deployed countermeasures. These advantages include the simultaneous engagement of all attacking vessels rather than engaging one or a few attackers at a time; onboard sensors to acquire and track targets and to determine the micromunition's own altitude and GPS coordinates to determine the closest target of interest selected by the target-weapon pairing algorithm and communicate that information to the other micromunitions to avoid redundant targeting; and a high explosive, enhanced blast explosive (including solid fuel-air explosive), incendiary, or other suitable explosive warhead designed to enhance the probability of a mission kill.

DETAILED DESCRIPTION OF THE EMBODIMENTS

Figure 4:
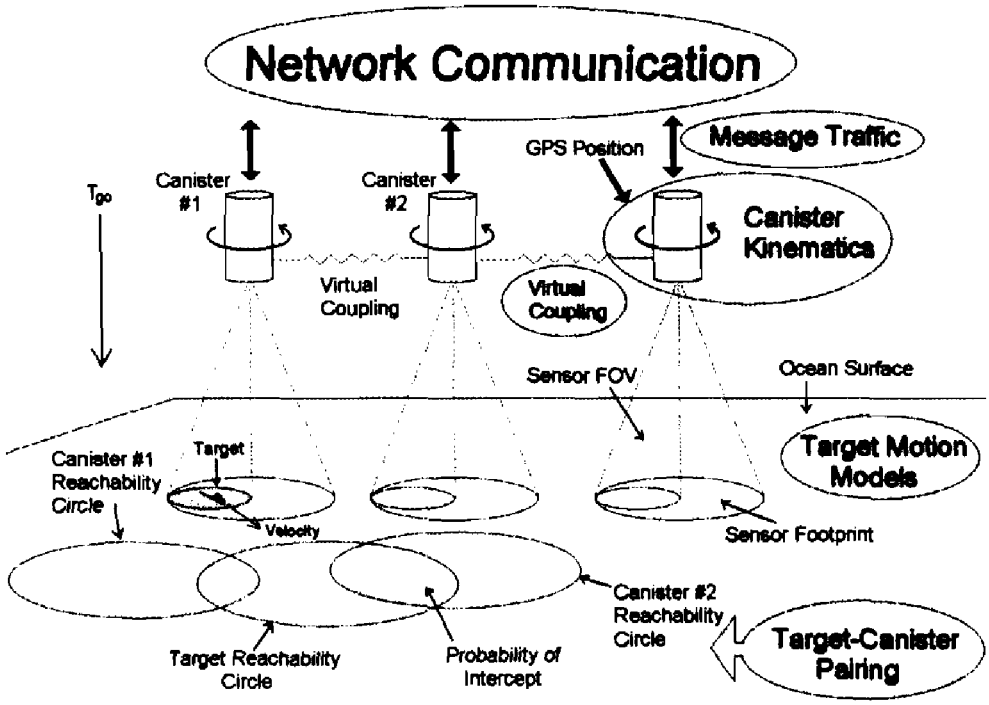
FIG. 4 of the drawings is a stylized depiction of a high-level overview of the essential elements of the cooperative multi-target tracking and intercept system.

With reference to FIG. 4, a typical operational scenario is illustrated. A plurality of micromunitions are ejected or deployed from a single or from multiple delivery vehicles or deployment platforms, and spread over a wide area to form a cooperatively interacting group, or swarm, of micromunitions. A large swarm of as many as about 500 micromunitions may engage more than 100 highly maneuverable asymmetric targets. Operationally, the canisters or micromunitions function cooperatively as autonomous agents that rely on simple instructions to achieve a common goal. The micromunitions are autonomous in that there is no centralized control, or hub, in the wireless communication network to direct them.

Each micromunition transmits messages to the other canisters concerning its sensor and flight dynamics measurements, and likewise receives such messages from each of the other micromunitions functioning as a node in the network. This message traffic is used initially or shortly after deployment to calculate micromunition-target assignments so as to maximize some selected objective, such as the global probability of intercepting all targets. Immediately following target assignment, the wireless communication network message traffic is used by each micromunition to compute an intercept trajectory to its paired target and to maintain a safe distance or spacing from the other airframes or canisters in the group, or swarm.

The message traffic between canisters is also used to dynamically adjust the inter-canister spacing as a function of target maneuver, and time-to-go, in order to increase the probability of killing (Pk) the target. The micromunitions share information so that all have access to the same knowledge database, stored locally within each canister, thereby creating a redundant distributed database within the robust wireless communication network. Accordingly, if a few micromunitions malfunction or are destroyed, the remaining micromunitions in the network continue, without interruption, to communicate and to cooperate as before.

Every micromunition contains a global position system (GPS) receiver, a wireless communication transceiver with local area wireless communication networking capability for communication with other micromunitions, and an inertial measurement unit (IMU), each linked with its onboard CPU, for measuring its position, velocity, and acceleration relative to some inertial reference frame, such as its point of deployment, and for communication with other like micromunitions. Micromunition altitude is obtained and provided to the onboard computer CPU via an integrated operably coupled laser range finder. Preferably, a low-cost infrared (IR) camera is used for detecting the angular position of targets within the vicinity of, and relative to, the micromunition.

The micromunition or canister is designed for subsonic flight and maneuverability at low altitude—so as to outmaneuver and intercept surface targets. Although reaction controls (thrusters) may be used as the vehicle's attitude control device to provide maneuverability and guidance, in a preferred embodiment canister or airframe attitude control is provided by active aerodynamic surfaces. Popout tailfins are used to afford directional stability. The tailfins are stowed in a retracted position to facilitate canister packing and to maximize volume utilization in the deployment platform. Guidance control and maneuverability is provided by forward placed attitude control devices such as active canard surfaces. We determined that this combination of control surfaces provides good canister maneuverability and preserves low body angles relative to the target to assure that the target does not leave the seeker sensor's field of view during the canister's flight to the target. The canards and tailfins are relatively small to facilitate stowage, but are sufficiently large to provide canister stability and control. The micromunition is unpowered and relies on the energy imparted by altitude and the velocity of the parent vehicle to arrive at the target.

Figure 3:
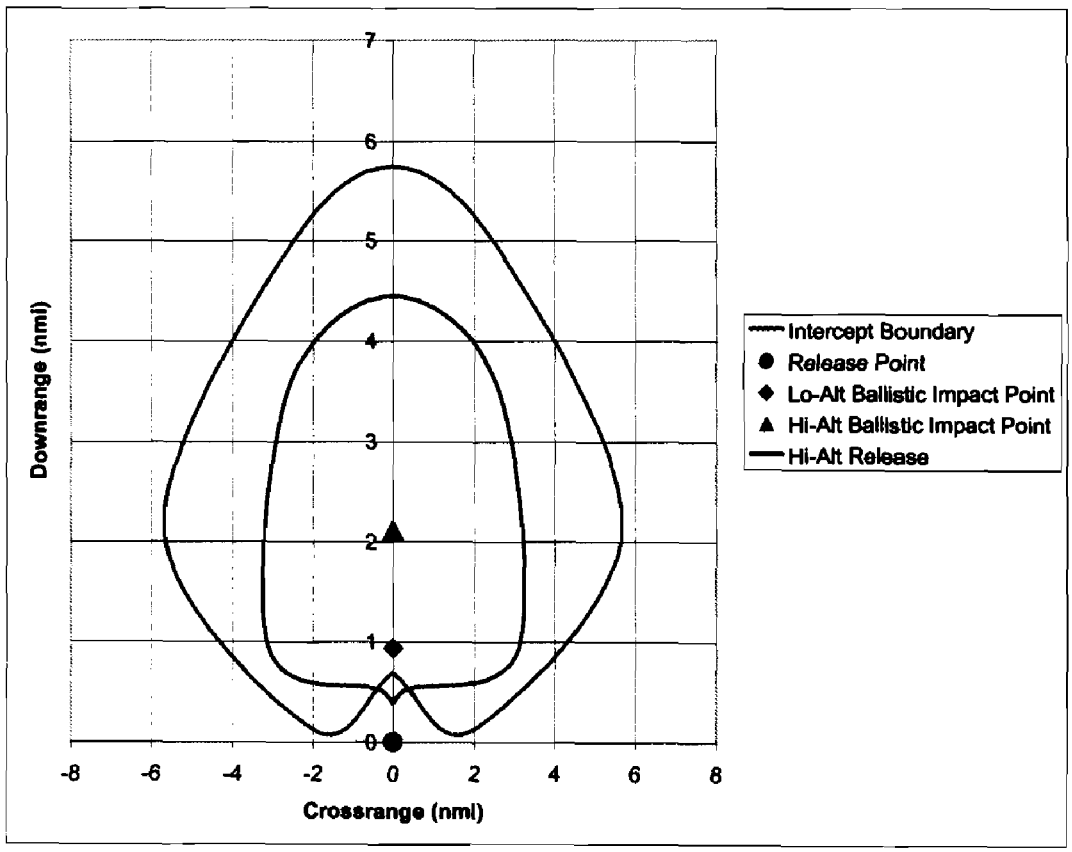
FIG. 3 of the drawings depicts a typical maximum micromunition/target intercept envelope.

FIG. 3 shows the maximum micromunition/target intercept envelope on a flat surface where the micromunition is released from a parent vehicle or deployment platform in level flight. In this example, the parent vehicle is traveling at Mach 0.8, and at either 1000 feet above the surface (low-altitude) or 5000 feet above the surface (high-altitude). The dot at the origin of the plot represents the micromunition or canister release point. The diamond (♦) at range=1 nmi, and triangle (▲) at range=2 nmi, represent the ballistic impact points for low-altitude and high-altitude releases, respectively, without guidance or if a target is not acquired. The inner closed line is the extent of where the micromunition could intercept a typical target from a low-altitude release, and the outer closed line represents the same capability but for a high-altitude release. In both cases, the micromunition or canister will retain enough energy to execute a 1.5 g final maneuver.

Figure 2:
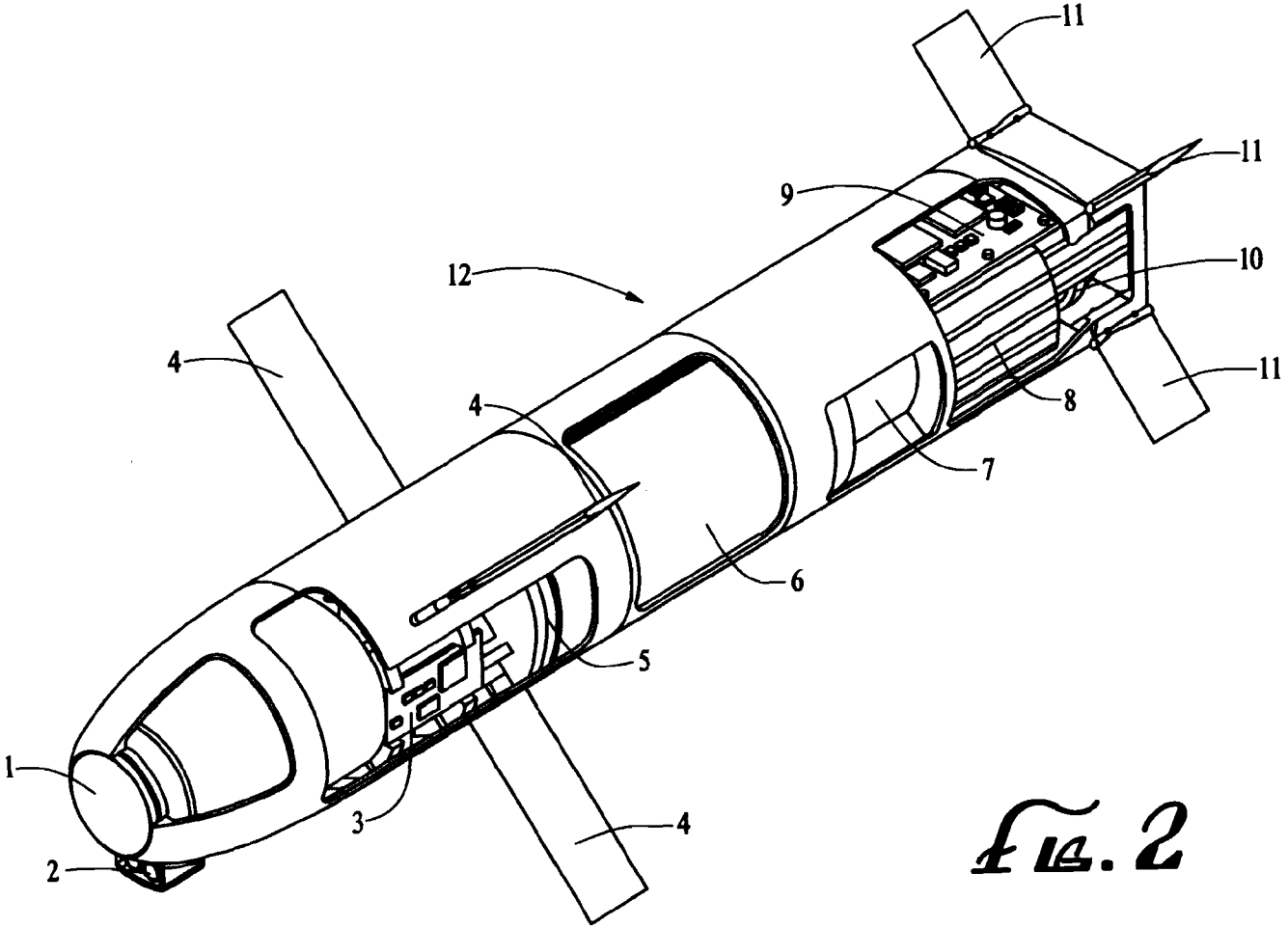
FIG. 2 of the drawings is a perspective partial cut-a-way view of a preferred plan form of the micromunition canister.

A preferred embodiment of the planform of the micromunition of the present invention is shown in FIGS. 1-2. With reference to FIGS. 1-2, in a preferred embodiment of the present invention, the canister or micromunition planform includes a stabilized airframe (12); flight attitude control devices consisting of active forward canard surfaces (4) and folding fixed tail fin (11) assemblies for flight control; enclosed sensors (1), (2); a control actuator system (CAS) or flight controller/servo unit (3), (4); a warhead section (5), (6) positioned near the center of gravity; sections containing the guidance and control system elements (7), (8), (9); and the systems' electrical power supply, batteries (10). The electrical power buses are not shown. In a preferred embodiment, the micromunition, or airframe, preferably has an overall length of about 18 inches and a body diameter of about 3 inches. Overall the micromunition weight is preferably in the range of about 8 pounds to about 12 pounds, with a warhead weight of about 4 pounds.

With further reference to FIGS. 1-2, the Guidance and Control System (GCS) includes the following elements operably coupled with the guidance and control computer or CPU (8); an Inertial Measurement Unit (IMU) (7); a Global Position System/Local Area Network (GPS/LAN) module (9) including a GPS receiver, a wireless communication transceiver, and their associated antennas and circuitry. The sensors include a seeker sensor package (1) for target acquisition and tracking, and a range finder (2) to establish range to target. Preferably, the seeker sensor package (1) contains a low-cost electro-optical/infrared sensor operably coupled with its associated signal processing circuitry that is operably coupled with the CPU. Preferably, the range finder (2) is a laser range finder and its associated circuitry. The seeker sensor package (1) and range finder (2) are positioned near the forward most or nose portion of airframe (12) and each is operably coupled with the CPU (8). The CPU (8) uses data collected by the seeker package (1) and range finder (2) to acquire and to track targets within the field of view of the seeker sensor and provide range and altitude data. The CPU (8) implements selected algorithms and uses targeting and position data from the GPS/LAN module (9), together with flight dynamics information from the IMU (7), and target data from the sensors (1), (2) to assign or pair with a target as well as to calculate flight path corrections that will steer the micromunition along an intercept trajectory to its paired target. The algorithms for target acquisition, weapon-target pairing, and for calculation of intercept trajectory are fully disclosed in U.S. application Ser. No. 10/963,001 filed Oct. 1, 2004, incorporated herein by reference as though set forth in full.

The CPU is operably linked with and provides instructions to the flight controller/servo unit (3) to operate the attitude control device or forward canards (4) to achieve the desired intercept trajectory flight path. The CAS unit is comprised of a multiple, independent three axis (roll, pitch and yaw axes) flight controller/servo unit (3) which is operably coupled with and actuates the forward canards (4) for aerodynamic control of the micromunition or airframe (12). The warhead section consists of the warhead (6) operably coupled with an Electronic Safe, Arm, Fuse Device (ESAFD) (5) that is operably linked with the guidance and control computer (CPU) (8). The warhead (6) is preferably an explosive warhead containing an enhanced blast explosive charge such as a solid fuel air explosive (SFAE) charge. Upon reaching the target, the computer (CPU) (8) instructs the ESAFD (5) to activate the warhead (6). All onboard electrical systems are powered by a source of electricity such as a power cell or, preferably, batteries (10) via appropriate electrical power buses operably coupled with the CPU, IMU, GPS receiver, wireless communication transceiver, laser range finder, flight controller unit, seeker sensor, sensor signal processing circuit, and ESAFD, respectively.

EXPERIMENTAL

To enable a better understanding of the complex interaction of the capabilities of a cooperative swarm as discussed above, progressive simulations incorporating varying degrees of network and sensor fidelity and control detail were conducted. A modular simulation incorporating all of the high-level components shown in FIG. 4 was created. Simple motion models for the threats and micromunitions were used in the initial studies, with Stochastic component uncertainties incorporated using parametric noise models. Subsequent refinements included a more extensive Monte Carlo capability, a Gaussian circular lethality model, a GPS model, an IMU model, a Laser range finder model, a Kalman filter for tracking pointing angle estimates, and a finite seeker field-of-view (FOV) model.

Figure 5:
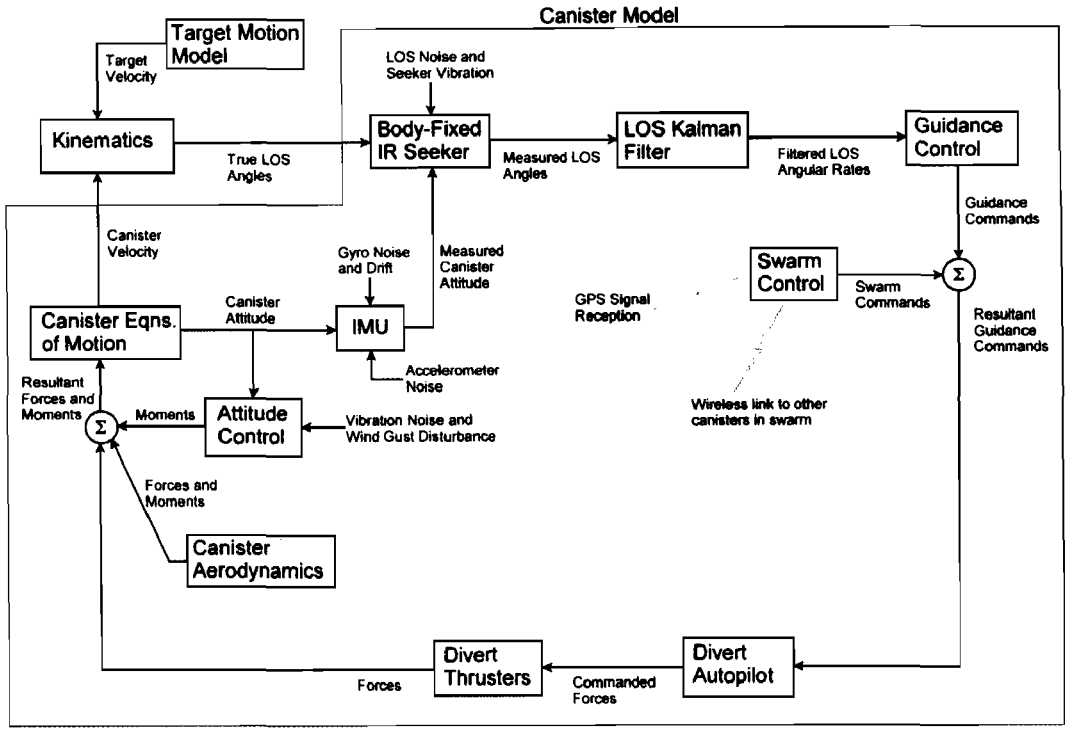
FIG. 5 of the drawings is a schematic of a swarm simulation depicting interaction among the linked models within the swarm simulation.

The interaction among the linked models within the swarm simulation is shown in FIG. 5. Although FIG. 5 shows only one target block and one micromunition block, the simulation can actually model an indefinite number of canisters engaging an indefinite number of targets, with the only real limit being the amount of computer memory required to store the variables used by the models. For a particular target-micromunition pair, the kinematic relationship between the pair is used to compute a true (error free) line-of-sight (LOS) angle that is sent to the seeker model. Parametric errors for LOS noise and canister body vibration are injected at the seeker level, and a measured LOS angle is computed relative to the inertial reference frame. The two-state angular Kalman filter makes an estimate of both the true LOS angle and true LOS angular rate, given the noisy measurement, and passes the angular rate estimate to the guidance-and-control computer. At this point, the guidance computer calculates the commands for driving the canister toward the target. Because the canister is only one node in a wireless communication network of many canisters, the swarm control command required for maintaining inter-canister separation and cohesion is added to the guidance command, and the resultant command is passed to the autopilot or flight controller. The autopilot or flight controller commands the attitude control device(s) such as the aerodynamic flight control surfaces and/or reaction control thruster to generate forces that will accelerate the canister toward the target, while simultaneously maintaining safe inter-canister spacing. The calculated resultant forces and moments are then used in the equations governing canister motion to compute the velocity of the canister relative to the inertial reference. The canister and target velocities are used in the kinematics model to compute a true line-of-sight angle to the target, thereby closing the simulation guidance loop.

The algorithms were also validated in hardware. Small mobile robots were used to simulate the behaviors of micromunitions and their targets. The robots were Parallax BOE-Bots® with Javelin microcontrollers programmed to simulate both formation control (by modeling virtual spring forces) and target-weapon pairing. To simulate GPS data an overhead camera monitored the positions and orientations of the robots, and a transmitter transmitted this information to the robots. A computer monitored and recorded the robots' activities.

Several scenarios were carried out, each varying the number of weapon robots, the number of target robots, and their starting positions. In every case the weapon robots successfully executed the target-weapon pairing algorithm and intercepted their assigned target robots, without colliding with each other.

The present invention has been described in connection with what are presently considered to be the most practical and preferred embodiments, it is to be understood that the invention is not to be limited to the disclosed embodiments, but to the contrary, is intended to cover various modifications, embodiments, and equivalent apparatus included within the spirit of the invention as may be suggested by the teachings herein, which are set forth in the appended claims, and which scope is to be accorded the broadest interpretation so as to encompass all such modifications, embodiments, and equivalent apparatus.

What is claimed is:

1. A counter asymmetric threat micromunition comprising:

a stabilized airframe adapted to be deployed from a deployment platform at an altitude above a target;

the stabilized airframe having at least one attitude control device effective after deployment of the airframe to maneuver the deployed airframe to a selected attitude;

a computer processing unit (CPU) operably coupled with a wireless communications transceiver, global positioning system (GPS) receiver, an inertial measurement unit (IMU), a range finder, a flight controller, an electronic safe-arm-fuze device, and with a signal processing circuit operably coupled to a sensor having a field of view adapted to detect a plurality of targets within its field of view;

a source of electrical power operably coupled with said sensor, said signal processing circuit, said CPU, said wireless communications transceiver, said GPS receiver, said IMU, said range finder, said flight controller operably coupled with said at least one attitude control device, and with said safe-arm-fuze device operably coupled with an explosive warhead;

said CPU operable via said wireless communications transceiver to establish a fast wireless communications network between, and to exchange selected data with, each other deployed like micromunition to form a redundant distributed database;

said CPU operable to assign a target to be intercepted, to calculate an intercept trajectory to the assigned target, to command said flight controller to operate said at least one attitude control device to guide the micromunition along said intercept trajectory, and to command said safe-arm-fuze device to arm and, upon intercept of the assigned target, to detonate said warhead.

2. A counter asymmetric threat micromunition comprising:

a stabilized airframe having a length, a diameter, a roll axis extending longitudinally along said length, a yaw axis, a pitch axis, and each said axis is orthogonal to each other said axis;

said airframe adapted to be deployed from a deployment platform and to glide to a target;

at least one attitude control device effective to rotate the airframe independently about each said axis to a selected orientation with respect to a selected frame of reference;

a sensor operable to detect one or more targets operably coupled to a signal processing circuit;

a computer processing unit (CPU) operably coupled with said signal processing circuit;

a transceiver antenna operably coupled with a wireless communications transceiver operably coupled with said CPU;

a global positioning system (GPS) antenna operably coupled with a GPS receiver operably coupled with said CPU;

an inertial measurement unit (IMU) operably coupled with said CPU;

a range finder operably coupled with said CPU;

a flight controller operably coupled with said CPU;

an explosive warhead operably coupled with an electronic safe-arm-fuze device operably coupled with said CPU;

said flight controller operably coupled with said at least one attitude control device;

a source of electrical power operably coupled with said sensor, said signal processing circuit, said CPU, said wireless communications transceiver, said GPS receiver, said IMU unit, said range finder, said flight controller, and said safe-arm-fuze device;

said CPU operable to run routines and algorithms for wireless communication, information measurement, information collection, information storage, information processing, guidance, position determination, target detection, target tracking, target assignment, target intercept, and warhead fuzing;

said CPU operable to run routines and algorithms to establish via said wireless communications transceiver a fast wireless communications network between other deployed like micromunitions;

said CPU operable to exchange with each other deployed like micromunition via said fast wireless communications network data for airframe address, position, velocity, acceleration, altitude, time-to-go until impact, imaging sensor data, target position data, GPS data, and IMU data to form a redundant database distributed among each deployed like micromunition;

said CPU operable to run routines and algorithms to establish, store, and update said distributed database formed among deployed like micromunitions;

said CPU operable to run routines and algorithms to assign a target to be intercepted, to calculate a trajectory to be followed to intercept a maneuvering assigned target, and to command said flight controller to operate said at least one attitude control device to guide the micromunition along said trajectory;

said CPU operable to run routines and algorithms to instruct said safe-arm-fuze device to arm and, upon intercept of the assigned target, to detonate said warhead.

3. The counter asymmetric threat micromunition of claim 2 wherein said length is about 18 inches and said diameter is about 3 inches.

4. The counter asymmetric threat micromunition of claim 1 or claim 2 wherein said at least one attitude control device is a movable surface disposed to extend into a slipstream passing around a deployed said micromunition.

5. The counter asymmetric threat micromunition of claim 1 or claim 2 wherein said at least one attitude control device is a reaction control thruster.

6. The counter asymmetric threat micromunition of claim 1 or claim 2 wherein said sensor is an electro-optical/infrared imaging sensor.

7. The counter asymmetric threat micromunition of claim 1 or claim 2 wherein said range finding device is a laser range finder sensor.

8. The counter asymmetric threat micromunition of claim 1 or claim 2 wherein said inertial measurement unit includes interferometric fiber optic gyroscopes.

9. The counter asymmetric threat micromunition of claim 1 or claim 2 wherein said warhead contains an enhanced blast explosive charge.

10. The counter asymmetric threat micromunition of claim 1 or claim 2 further including a range finding device operably coupled with said CPU and with said source of electrical power.

* * * * *